United States Patent [19]

Bisson et al.

[11] Patent Number: 4,719,866

[45] Date of Patent: Jan. 19, 1988

[54] SEWING MACHINE WITH CONTROL DEVICE FOR THE NEEDLE DRIVING MOTOR

[75] Inventors: Flavio Bisson, Cava Manara; Giacomo Cattaneo, Pavia, both of Italy

[73] Assignee: Necchi Societa per Azioni, Pavia, Italy

[21] Appl. No.: 936,390

[22] Filed: Dec. 1, 1986

[30] Foreign Application Priority Data

Dec. 18, 1985 [IT] Italy ..... 42916 A/85

[51] Int. Cl.[4] ..... D05B 69/22

[52] U.S. Cl. ..... 112/275

[58] Field of Search ..... 112/275, 277, 220, 67, 112/87, 121.11

[56] References Cited

U.S. PATENT DOCUMENTS 4,195,582 4/1980 Novick et al. ..... 112/275 X 4,586,448 5/1986 Lerch et al. ..... 112/275

*Primary Examiner*—Peter Nerbun

*Attorney, Agent, or Firm*—Stevens, Davis, Miller & Mosher

[57] ABSTRACT

A sewing machine, and a control device for the needle driving motor comprising an electronic circuit which employs logic gates and at least one capacitor for its working in such a way as to obtain a simple, reliable and cheap control device.

5 Claims, 1 Drawing Figure

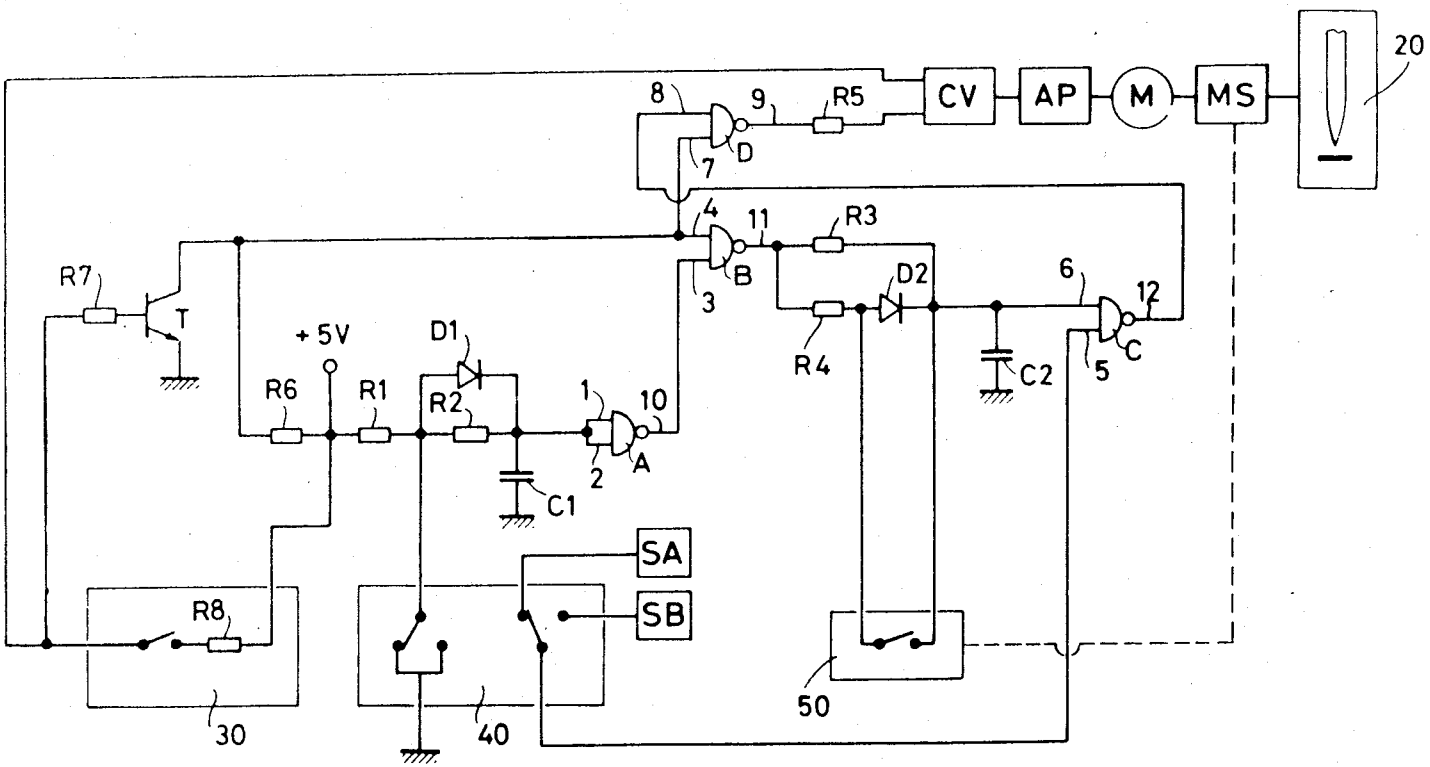
20
MS
M
AP
CV
R5
9
D
8
7
4
11
B
3
R3
D2
R4
12
C
5
6
C2
50
10
A
1
2
C1
D1
R2
R1
+5V
R6
T
R7
SA
SB
40
R8
30

SEWING MACHINE WITH CONTROL DEVICE FOR THE NEEDLE DRIVING MOTOR

DISCLOSURE OF THE INVENTION

The present invention relates to a sewing machine with a control device for the needle driving motor. Sewing machines are provided with a motor which, via a kinematic chain, drives with reciprocating movement a sewing needle between an extremely high position and an extremely low position (hereinafter simply indicated as high and low position). The sewing machine is usually provided with an external regulator with which, when the machine is started by a general external switch, the operator controls the driving of the motor from a zero speed to a maximum speed. Some types of sewing machines comprise moreover externally a needle stop position selector with two positions corresponding to the stop of the needle respectively in the high and low position. These types of sewing machines comprise also an internal switch which is activated when the operator mechanically disengages the sewing needle from the motor. In the inside of the above-mentioned types of sewing machines there is present a motor control electronic circuit operatively connected to the regulator, to the position selector and to the internal switch. The control circuit also is connected to two position sensors operatively connected to the kinematic chain between the motor and the needle. One sensor indicates to the control circuit when the needle is in its high position while the other sensor indicates to the control circuit when the needle is in its low position. These sewing machines have four main working conditions:

(1) sewing: the motor controlled by the regulator turns continually, independently from the signals arriving from the position sensors;

(2) needle positioning when the regulator is placed in the zero speed position of the motor: the motor stops the needle in the position (high or low) indicated by the position selector; when the machine is stopped it is possible to carry the needle out of position acting manually on the hand-wheel;

(3) execution of the bobbin winding: the motor is mechanically disengaged from the needle and, as known, the motor is only used in order to wind the thread coming from a spool on the bobbin obviously acting on the regulator; in this case the motor stops as soon as the regulator is released;

(4) needle positioning in high or low position: when the machine is motionless, operating on the position selector, the needle is displaced in one or the other of the two positions.

The control circuit of course operates in such a way that the sewing machine can give the above-mentioned performances opportunately coordinating the various elements with which it is connected. In known sewing machines this circuit is quite complicated, less reliable and results in a higher cost for the same circuit and thus of the sewing machine.

It is an object of the present invention to provide a sewing machine which overcomes the above-mentioned drawbacks, i.e., which has a control device for the various functions characterized by simplicity, reliability and low cost.

Such object is achieved by means of a sewing machine comprising a motor for reciprocating a sewing needle between a first and a second extreme position, a motor speed regulator for obtaining a zero speed and a maximum speed, a switch operated by means adapted to mechanically disengage the sewing needle from the motor, a position selector having at least two positions for controlling the motor in order to stop the needle at least in the first or in the second extreme position. The machine further comprises at least first and second sensor means, operatively connected to the position selector, supplying a control electric signal respectively when the needle is in the first extreme position and in the second extreme position, first means being provided of the logic gate type with a first and a second input and an output, which commutate from the first and a second logic condition and vice versa, i.e., a first logic condition in which at its output an electric signal is present which controls the starting of the motor and a second logic condition in which at its output an electric signal is present which controls the stopping of the motor, the first input of said logic gate means being operatively connected to the regulator in such a way that when the regulator is in its motor starting position, the first logic gate means is in its first logic condition and when the regulator is in its motor stopping position, the first logic gate means commutate from one to the other of its two logic conditions according to the logic level present at its second input, second means being moveover provided of the logic gate type having a first and a second input and an output, the output of the second means being connected to the second input of the first means, the second means commutating from a first to a second logic condition and vice versa, the commutation of the second means from one to the other of its two logic conditions causing the commutation of the first means from one to the other of its two logic conditions when the regulator is in the motor stopping position, first capacitor means being moreover provided connected to the first input of the logic gate second means and operatively connected to the regulator and to the switch, the first capacitor means being electrically charged when the regulator is in its motor starting position and being electrically discharged when the switch is in the position corresponding to the disengagement of the needle from the motor, the first capacitor means, when it is charged, keeping the second logic gage means in conditions of non-commutation, one or the other of the first and second sensor means, depending on the position of the selector, being connected to the second input of the second logic gate means in such a way as to supply to it the electric control signal, the electric control signal, when this regulator is in its motor stopping position, causing the commutation of the second logic means from one logic condition to the other in such a way as to cause the commutation of the first logic means in the logic condition corresponding to the stopping of the motor.

In order to understand the characteristics and advantages of the present invention, a description of one exemplifying, non-limitative embodiment is hereafter given, illustrated in the accompanying drawing in which is schematically shown the control device for the driving motor of a needle of a sewing machine according to the invention.

The sewing machine referred to in the following description is of the common type comprising in its structure a bed from which a standard laterally rises, and from which, in turn, a bracket arm extends ending with a head supporting the sewing means needle bar and needle. Such a sewing machine is not illustrated in its structure because of being of the known type. In the figure only some components of the sewing machine are illustrated. In particular block 20 schematizes the sewing needle and with motor M, which, via an opposite known kinematic chain, reciprocates the needle 20 between an extremely high and an extremely low position. An external foot rheostat 30 controls the speed of the motor M between a zero value and a maximum value. An external selector 40 positions the needle stop in two positions corresponding to the stop of the needle respectively in a high and in a low position. An internal switch of the known type 50 is operated by means which mechanically disengages the needle 20 from the motor M, indicated in the figure with the block MS: when the needle 20 is disengaged from the motor M the above-mentioned disengaging means carries the switch 50 in a closed position.

The figure principally illustrates the device which controls the motor M on the basis of information coming to it from foot controller 30, from the selector 40 and from the switch 50. The device provides principally two needle position sensors schematized by means of blocks SA and SB, connected to the selector 40. The sensors SA and SB emit a particular electric signal, as will be afterward explained, when the needle 20 is respectively in the high and low position (i.e., the sensor SA for the high position and the sensor SB for the low position). Such sensors may be of the Hall Effect type operatively connected to a shaft comprised in the kinematic chain connecting the motor M to the needle 20 according to known art.

A secondary electronic circuit, of known type, is provided for the control of the needle 20, schematized with the block CV, whose input is connected to the foot controller 30 and whose output is connected to a power amplifier AP which feeds the motor M when the foot controller 30 is in a position of a speed of the motor M different from zero (closed position). The secondary circuit CV does not operate and the motor M turns at the speed determined by the foot controller 30. When the foot controller 30 is in the zero speed position of the motor M (open position), the secondary circuit CV supplies a suitable signal to the power amplifier AP in such a way that the speed of the motor M is at a fixed speed corresponding to a speed of the needle 20 which is much lower than the operative speeds. The reasons for this will be clarified subsequently. The control device of the motor M provides moreover a set of electronic components operatively connected to the foot controller 30, to the selector 40 and through the selector 40 to the sensor SA and SB, to the switch 50 and at last to the secondary circuit CV as shown in the figure. The above-mentioned electronic components are formed by:
a set of logic gates A, B, C, D of the NAND type, with inputs and outputs indicated with the numbers 1–12;
a set of resistances $R_1$, $R_2$, $R_3$, $R_4$, $R_5$, $R_6$, $R_7$, $R_8$;
two capacitors $C_1$ and $C_2$;
two diodes $D_1$ and $D_2$;
one transistor T.

The circuit of the above-listed electronic components is fed by a tension source of +5 volt. The working of the control device will be described hereinafter, illustrated with reference to the four main conditions of the sewing machine working indicated in the introductory part of this description.

(1) Sewing

By pressing and thus bringing into a closed position the foot controller 30, the transistor T is conducting and establishes a low logic level at the input 7 of the gate D. An electric signal will be present at the output 9 of the gate D (afterwards the word "signal" will be simply used for indicating an electric signal) of high logic level (i.e., the output 9 will be at high logic level) independently from the logic level of the signal arriving at the input 8 of the same gate D. The output 9 of the gate D is connected to a particular input of the secondary circuit CV in such a way that, when a low logic level signal arrives at this input, the power amplifier AP does not feed the motor M and when, on the contrary, a high logic level signal arrives at the input, the power amplifier AP feeds the motor M. Thus in the above-described situation, with high logic level signal at the output 9 of the gate D, the amplifier AP feeds the motor M and this last turns at the speed determined by the foot controller 30.

(2) Positioning of the needle when the foot controller is released

It must be stated in advance, that in the previous situation the commutation into conduction of the transistor T brings the input 4 of the gate B to a low logic level and thus a high logic level signal will be present at the output 11 of the gate B. Such high logic level signal charges the capacitor $C_2$ through the resistances $R_3$ and $R_4$ and the diode $D_2$. When the tension voltage level in $C_2$ overcomes half of the feed tension of the circuit (thus it exceeds +2.5 volt) the gate C presents at its input 6 a high logic level signal and thus supplies to its output 12 a logic level signal depending on the logic level of the signal at its input 5. More particularly, a high logic level signal will be present at the output 12 when a low logic level signal will be present at the input 5 and vice versa.

It must be moreover stated that the needle position sensors SA and SB, one or the other of them, depending on the position of the selector 40, is connected to the input 5 of the gate C, emit a low logic level signal when the needle 20 passes into the position detected by them. In all the other positions of the needle 20 a high logic level signal arrives at the input 5. When the foot controller 30 is released (i.e., carried into the open position as in the figure), it is first of all to say, as previously explained, that through the secondary circuit CV a predetermined speed corresponding to a speed of the needle 20 much lower than the normal operative speed is established for the motor M.

The releasing of the foot controller 30 causes the transistor T to not conduct and a high logic level will be present at the input 7 of the gate D and at the input 4 of the gate B. The output 9 of the gate D will be at a high or low logic level and thus the motor M will turn or not depending on the logic level of the input 8 of the same gate D. If such level is low the motor M turns, otherwise it will stop. The logic level at the input 8 of the gate D depends on the logic level of the output 12 of the gate C. As already stated, since the logic level at the input 6 of such gate C is high due to the action of the capacitor $C_2$, the logic level at the output 12 of the gate C depends only on the logic level of its input 5 connected, in an illustrative way in the figure, to the sensor SA.

As a consequence of that, until the needle 20 has not reached its superior position, a high logic level is present at the input 5 of the gage C. Thus, a low logic level is present at the output 12 of the gate C and at the input 8 of the gate D and as a consequence at the output 9 of the gate D there is a high logic level signal, which causes the motor to turn. When the needle 20 reaches its superior position, the sensor SA supplies a low logic level signal to the input 5 of the gate C. Thus at the output 12 of the gate C and at the input 8 of the gate D there is a high logic level and as a consequence, as also the input 7 of the gate D is at a high logic level, at the output 9 of the gate D there is a low logic level signal which causes the motor M to stop.

Substantially, when the foot controller 30 is released, the needle 20 passes from its operative speed to a much lower speed and stops when it has reached its superior position. The passage of the needle 20 from its operative speed to a much lower speed is necessary. In fact if, on the contrary, it maintained its operative speed, it would not stop in its superior position but it would continue to rotate due to the inertia. Obviously if the selector 40 is displaced on the sensor SB, the control device works in the same above examined way with the difference that the stopping of the motor M occurs when the needle 20 is in its low position. It is to point out that when the foot controller 30 is released and thus the transistor T does not conduct, the output 11 of the gate B is at a low logic level and thus the voltage on the capacitor $C_2$ will reduce as this discharges on the resistance $R_3$ (in the present operative condition the switch 50 is open). When such voltage reduces under half of the feed voltage, at the input 6 of the gate C there is a low logic level and at its output 12 there is therefore a high logic level which causes, for what above explained, the stopping of the motor M. Thus, after a certain time from the release of the foot controller 30, equal to the discharge time of the capacitor $C_2$, the motor M and thus the needle 20 stopping anyhow. In any case this discharge time of the capacitor $C_2$ must be such as to permit, anyway, the stop of the needle 20 either in the high position or in the low position, according to the position of the selector 40. In other words, the capacitor $C_2$ must keep in commutation status the gate C until the low logic level signal of the position sensor (SA or SB) arrives at the input 5 of this gate. When the foot controller 30 is released, it is possible to carry the needle out of position, manually acting on a hand wheel, without the motor M starting.

In fact, as the capacitor $C_2$ is discharged, at the output 12 of the gate 5 there is a high logic level and thus the motor M remains motionless. Obviously, the discharge time of the capacitor $C_2$ will have to be calibrated in such a way that the voltage at the capacitor $C_2$ reduces under half of the feed voltage, immediately after the release of the foot controller 30 for avoiding that, by displacing the needle 20 from the extreme reached position, at the output of the gate C there is a low logic level, as its inputs 5 and 6 are at a high logic level, and thus the motor starts.

(3) Execution of the bobbin winding

By the disengaging means the needle 20 is disengaged from the motor M and thus the switch 50 commutates in closed position. When the foot controller 30 is pressed, the control device working is the one already explained at the point (1) and the motor M causes the needle 20 to move at the operative speed established by the same foot controller.

When the foot controller 30 is released, the working logic of the control device is that shown at the point (2); in this case, however, the closing of the switch 50 puts in short-circuit the diode $D_2$, operating the paralleling of the resistances $R_3$ and $R_4$ and causes the capacitor $C_2$ to discharge very quickly. This means, for what was described at the point (2), that the motor M, and thus the needle 20, stop when the foot controller 30 is released, as it is required in this operative condition of the sewing machine.

(4) Needle positioning in high or low position when the sewing machine is motionless When the selector 40 is displaced from the position shown in the figure, corresponding to the stop of the needle 20 in high position, to the position corresponding to the stop of the needle 20 in low position, the following occurs. During the commutation of the selector 40 from one position to the other, the capacitor $C_1$ is charged by the feed source (+5 V) through the resistance $R_1$ and the diode $D_1$.

As a consequence both inputs 1 and 2 of the gate A become high and its output 10 becomes low. The output 11, that when the machine is motionless is low, becomes high and thus the condensor $C_2$ charges. When the voltage at the capacitor $C_2$ exceeds half of the feeding circuit tension, for what explained at point (2), the motor M starts and causes the needle 10 to move. When the selector 40 has displaced in the position corresponding to the stop of the needle in low position, connecting the sensor SB to the input 5 of the gate C, the condenser capacitor $C_1$ discharges through $R_2$ and through a mobile contact of the selector 40. This causes the commutation of the gates A and B in the initial condition, i.e., the output 10 of the gate A becomes again high and the output 11 of the gate B becomes again low. As a consequence the capacitor $C_2$ discharges.

However, until the voltage at the condensor $C_2$ is higher than half of the feeding circuit voltage and until the needle 20 is out of its low position, as explained at the point (2), the motor M turns. When the needle 20 reaches its low position and thus the sensor SB supplies the commutation signal to the gate C or when the voltage at the capacitor $C_2$ reduces under half of the feed voltage, the motor M stops, causing the needle 20 to rest.

As already stated at point (2) the discharge time of the capacitor $C_2$ must be such as to permit the needle 20 to stop in the predetermined position. Thus displacing the selector 40 in the way above indicated, the needle automatically moves in its low position.

From what has been described and illustrated it can be understood how the control device is simple either as a circuit structure or as a working mode.

The simplicity assures the reliability of the circuit and permits low production costs for the same. The reliability is increased by the use of logic gates. In fact, as it is known, the characteristics of the binary working of the logic gates give particular operative reliability to a circuit which uses them, permitting, moreover, to avoid that fluctuation in the feed voltage and in the internal voltage of the circuit, obviously within certain limits, influencing the working of the same circuit.

With obvious modifications a position selector with many positions can be utilized and, correspondingly, also many position sensors, in order to stop the needle in positions intermediate with respect to the extreme positions already examined. The working principle is completely similar to the one already considered.

We claim:

1. Sewing machine comprising a motor for reciprocating a sewing needle between a first and a second extreme position, a motor speed regulator for obtaining a zero speed and a maximum speed, a switch operated by means adapted to mechanically disengage the sewing needle from the motor, a position selector having at least two positions for controlling the motor in order to stop the needle at least in the first or in the second extreme position, the machine comprising at least first and second sensor means, operatively connected to the position selector, supplying a control electric signal respectively when the needle is in the first extreme position and in the second extreme position, first means being provided of the logic gate type with a first and second input and an output, which commutate from a first and a second logic condition and vice versa, said first logic condition in which at said output an electrical signal is present which controls the starting of the motor and a second logic condition in which at said output an electric signal is present which controls the stopping of the motor, the first input of said logic gate means being operatively connected to said regulator in such a way that when said regulator is in its motor starting position, said first logic gate means is in its first logic condition and when said regulator is in its motor stop position, said first logic gate means commutates from one to the other of its two logic conditions according to the logic level present at its second input, second means being moreover provided of the logic gate type having a first and a second input and an output, the output of said second means being connected to the second input of said first means, said second means commutating from a first to a second logic condition and vice versa, the commutation of said second means from one to the other of its two logic conditions causing the commutation of said first means from one to the other of its two logic conditions when said regulator is in the motor stop position, first capacitor means being moreover provided connected to the first input of said logic gate second means and operatively connected to the regulator and to the switch, said first capacitor means being electrically charged when the regulator is in its motor starting position and being electrically discharged when the switch is in the position corresponding to the disengagement of the needle from the motor, said first capacitor means, when it is charged keeping said second logic gate means in condition of non-commutation, one or the other of said first and second sensor means, depending on the position of the selector, being connected to the second input of said second logic gate means in such a way as to supply to it said electric control signal, said electric control signal, when this regulator is in its motor stop position, causing the commutation of said second logic means from one logic condition to the other in such a way as to cause the commutation of said first logic means in the logic condition corresponding to the stopping of the motor.

2. Sewing machine according to claim 1, wherein said first capacitor means is discharged when said regulator is in the stop position of the motor, said position selector being operatively connected to a circuit which charges said first capacitor means when said position selector is in an intermediate positon between its two positions corresponding to the needle stop extreme positions.

3. Sewing machine according to claim 2, in which said circuit includes third logic gate means with a first and a second input means and output means, which commutates from a first one to an other logic condition and vice versa, said one logic condition in which at said output means there being present an electrical signal which charges said first capacitor means, and said other logic condition in which said output reaches an electrical level such as to discharge said first capacitor means, the first input of said third logic gate means being operatively connected to said regulator in such a way that, when said regulator is in motor driving position, said third logic gate means is in the one logic condition and, when said regulator is in motor stop position, said third logic gate means commutates from one to the other of its two logic conditions, depending from the logic level present at its second input, said second input means being connected to second capacitor means charged in the intermediate positions of the selector and discharged in the two positions of the selector corresponding to the extreme stop positions of the needle, said second capacitor means, when it is charged, causing the commutation of said third logic gate means into its first logic condition and, when it is discharged, causing the commutation of said third logic gate means into its other logic condition.

4. Sewing machine according to claim 1, including transistor means connecting said regulator to said first logic gate means, said regulator, according to its driving or stop motor position, piloting the transistor means either in conducting or in non-conducting position, said transistor means controlling, by its two said positions, the feed of an electrical signal source to said first logic gate means in order to carry it either into its first logic condition or into the commutation state from a logic condition to the other one.

5. Sewing machine according to claim 3, including transistor means connecting said regulator to said first and third logic gate means, said regulator piloting, according to its position, the transistor means either in conducting position or in non-conducting position, said transistor means controlling, by their two said positions, the feed of an electrical signal source to said first and third logic gate means in order to carry them either into their first logic condition or into the commutation state from a logic condition to the other one.

* * * * *